United States Patent [19]
Sherman
[11] 4,279,459
[45] Jul. 21, 1981

[54] PRINTED WIRING BOARD AND CONNECTOR APPARATUS

[75] Inventor: Charles J. Sherman, Westminster, Colo.

[73] Assignee: Bell Telephone Laboratories, Incorporated, Murray Hill, N.J.

[21] Appl. No.: 105,558

[22] Filed: Dec. 20, 1979

[51] Int. Cl.[3] ..... H01R 9/09; H01R 13/029
[52] U.S. Cl. ..... 339/75 MP; 339/170 MP
[58] Field of Search ..... 339/65, 66 M, 17 L, 339/17 LC, 75 M, 75 MP, 176 MP, 184 M, 186 MM

[56] References Cited

U.S. PATENT DOCUMENTS

| | | | |
|---|---|---|---|
| 3,188,598 | 6/1965 | Pferd | 339/17 L |
| 3,594,699 | 7/1971 | Jayne et al. | 339/75 MP |
| 3,710,303 | 1/1973 | Gaurger | 339/17 L X |
| 3,858,957 | 1/1975 | Harwood et al. | 339/17 L |
| 3,950,057 | 4/1976 | Calabro | 339/65 |
| 4,002,381 | 1/1977 | Wagner et al. | 312/183 |
| 4,018,495 | 4/1977 | Freitag | 339/17 L |
| 4,060,295 | 11/1977 | Tomkiewicz | 339/17 LC |

FOREIGN PATENT DOCUMENTS

| | | | |
|---|---|---|---|
| 2732519 | 2/1979 | Fed. Rep. of Germany | 339/65 |

*Primary Examiner*—Eugene F. Desmond
*Attorney, Agent, or Firm*—William H. Kamstra

[57] ABSTRACT

A printed wiring board (20) and connector (12) apparatus in which a coordinate array of terminal contact areas (22) on the board (20) make only simultaneous and exclusive electrical contact with a corresponding array of connector contact springs (24). Premature and unwanted electrical contacts are prevented as the board (20) is moved into association with the connector (12) by cams (23) protruding from the board (20) which maintain a separation between the board contact areas (22) and the connector springs (24) until full movement of the board is completed. At this point, the cams (23) are seated in corresponding recesses (26) provided therefor in the connector (12) surface to permit the mating of contact areas and springs.

8 Claims, 5 Drawing Figures

PRINTED WIRING BOARD AND CONNECTOR APPARATUS

TECHNICAL FIELD

This invention relates to electrical interconnection apparatus and particularly to such apparatus for interconnecting electrical assemblies, such as printed wiring boards, for example, and other electrical system components and circuits.

BACKGROUND OF THE INVENTION

Printed wiring boards and their mounting frames of the character described, for example, in U.S. Pat. No. 4,002,381 of D. R. Wagner et al., issued Jan. 11, 1977, are well-known in the art and have long provided an advantageous means for assembling and mounting relatively large numbers of electrical components. Typically, circuits extending from the components in the form of wiring printed on the board are extended to terminal contact areas arranged along a leading edge of the board. These terminal areas are spaced to mate with corresponding contact springs of a connector into which the leading edge of the board is inserted. Suitble frames and racks are provided to support a number of the boards and also provide a means for guiding the boards for their insertion in and removal from the respective connectors. The connectors are in turn adapted to mate with pins extending from a backplane or with other interconnection apparatus as is also known. In order to achieve an orderly physical organization, the dimensions of the printed wiring boards are generally standardized within a given system and may even be so standardized among various suppliers. Although convenient from an interchangeability viewpoint, the fixed dimensions of a board within a given system and particularly the dimension of the board leading edge, ultimately imposes a severe limitation on the number of terminal contact areas which may be provided. This in turn limits the number of electrical components and circuits which may be mounted on the board notwithstanding the available board mounting area.

One obvious expedient in providing more board leading edge terminal contact areas is to decrease their widths and spacings; this measure, however, is temporary as minimum limits of the contact areas and spacings are approached. Additional columns of contact areas have in the past also been provided inwardly from the board leading edge, the resulting array of contact areas then being adapted to mate with multiple tiers of connector springs. Although significantly increasing the number of circuit board terminations, the latter arrangement presents a problem not encountered in connection with boards having a single leading edge column of terminal contact areas. When a single column board is inserted in its connector, each of its contact areas simultaneously makes electrical contact with its corresponding connector contact spring. No premature or erroneous electrical connections are normally possible during the time the board is being inserted. In a multi-column contact arrangement, on the other hand, the connector contact springs adapted to make electrical connections with the contact areas of the circuit board beyond the first column of necessity pass each contact area of the preceding columns. Were the connector contact springs actually to wipe such preceding column board contact areas, serious damage could be done to board circuit components where the connector springs are included in active circuits. It is thus necessary in many system applications that the connector contact springs make selective and simultaneous electrical contact with their respective circuit board terminal contact areas. It is to the problem of achieving such selective and simultaneous contact that the apparatus of this invention is chiefly directed.

SUMMARY OF THE INVENTION

The foregoing objective is realized and a technical advance is achieved in accordance with the principles of this invention in a printed wiring board-connector apparatus in which the board and connector contact area and spring pairs make selective and simultaneous electrical contact only when the board completes full insertion in its connector. The connector comprises a block having terminal pins spaced and arranged for insertion in the via holes of a backplane or the sockets of other interconnection apparatus. The block pins are internally connected to respective contact springs of an array of such springs presented at the side of the block. The spacings of the spring array correspond to the spacings of an array of terminal contact areas affixed to the leading end portion of a printed wiring board. As the board is inserted between frame guide rails, the array of board contact areas make respective electrical contact with the block contact springs when the board is fully inserted. Premature contact is prevented and the simultaneous mating of corresponding board contact areas and block contact springs is ensured by cams protruding from the face of the printed wiring board at its leading end portion. As the board is inserted opposite the connector block, the cams slide on the opposing block face until matching recesses provided in the block face are reached. At this full insertion point, the cams are received into the recesses under the urging of springs provided on the guide rails thereby permitting the simultaneous and correct mating of the connector block springs and board contact areas. Advantageously, any active circuits presented by the connector block springs are thus completed only and exclusively with the desired printed wiring board circuits and components.

BRIEF DESCRIPTION OF THE DRAWING

The organization and operation of the electrical interconnection apparatus according to this invention together with its features will be better understood from a consideration of the detailed description of one illustrative embodiment thereof which follows when taken in conjunction with the accompanying drawing in which.

DETAILED DESCRIPTION

Figure 1:
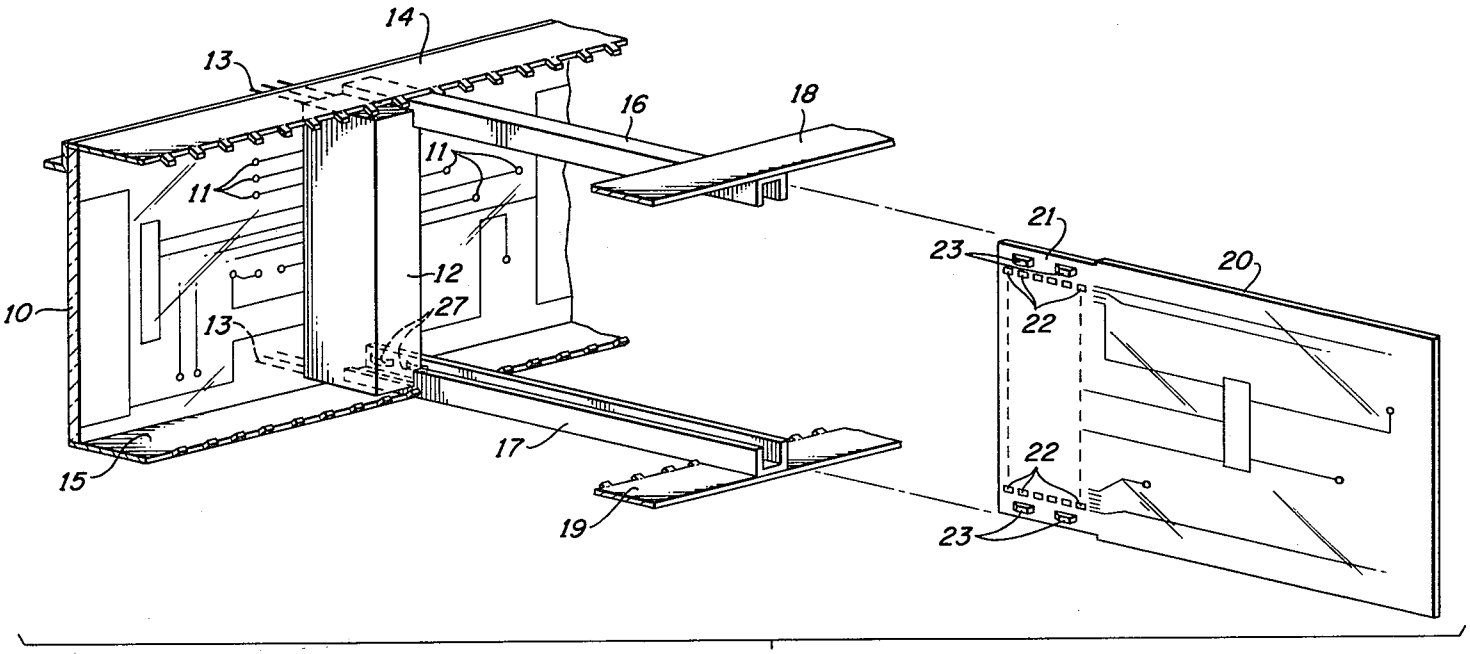
FIG. 1 depicts a representative backplane connector organization showing a connector block and a printed wiring board according to the invention, the connector block being shown in place at the backplane in relation to portions of a frame assembly and the wiring board being shown in alignment with guide rails preparatory to its insertion therebetween.

A portion of a typical backplane interconnection organization in which a connector-printed wiring board apparatus of the invention is advantageously adapted for use is depicted in FIG. 1. This organization may comprise a backplane 10 which itself may have mounted thereon printed wiring interconnecting an array of via holes 11 adapted to receive the pins of a printed wiring board connector. A single illustrative connector block 12 having its pins 13 so inserted in holes 11 is shown mounted on the backplane 10 between a pair of frame members 14 and 15 and a pair of guide rails 16 and 17. Guide rails 16 and 17 are mounted at one end between frame members 14 and 15, respectively, and at the other end between other frame members 18 and 19, representative portions of which are shown in the figure. A printed wiring board 20 featuring a leading edge portion 21 according to the invention is shown in alignment with guide rails 16 and 17 preparatory to its insertion therebetween. Board 20, which is also shown in enlarged view of FIG. 2 as partially inserted between rails 16 and 17, has affixed thereto at leading edge portion 21 a coordinate array of terminal contact areas 22. The latter are typically connected by means of printed wiring to circuits and components mounted on the remaining portion of the board. Also mounted on board 20 or comprising integral parts thereof at its upper and lower sides respectively are two pairs of cams 23 protruding out from its face. Board 20 is shown in FIG. 2 between sectioned guide rails 16 and 17 in a position just before its final insertion in opposition to its connector block 12.

Figure 2:
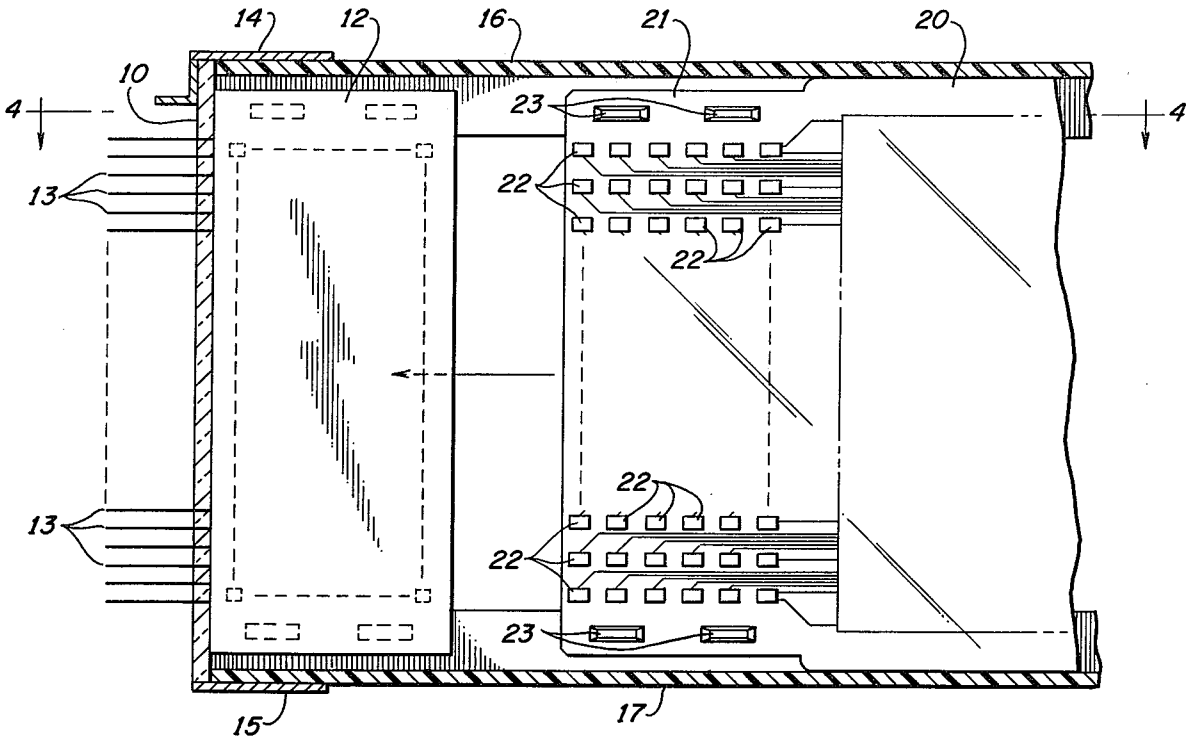
FIG. 2 is an enlarged view of the printed wiring board of FIG. 1 shown in place between sectional guide rails preparatory to its final movement into association with a connector block, the view showing the contact area face of the board.
Figure 3:
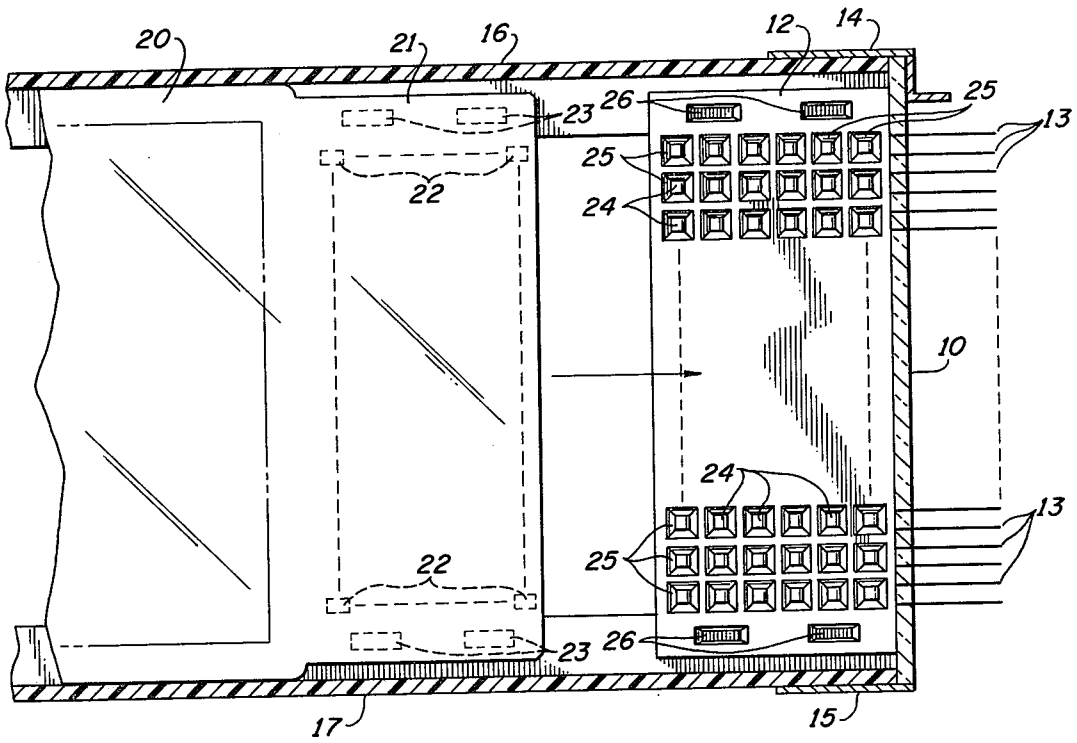
FIG. 3 is a reverse view of the view of FIG. 2 showing the contact spring face of the connector block.
Figure 4:
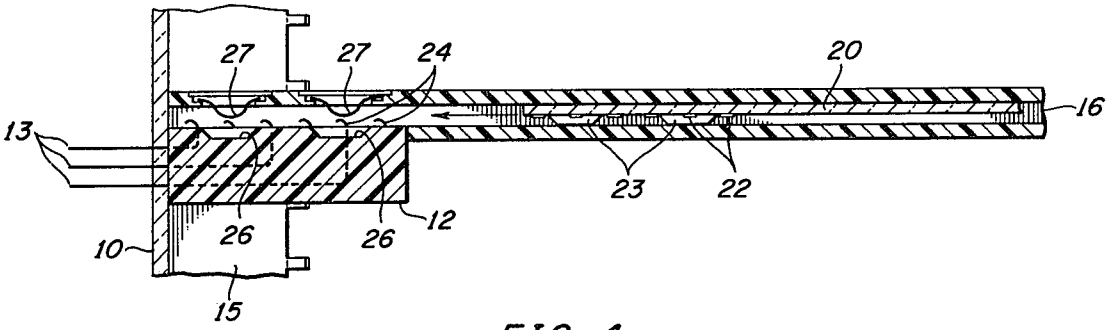
FIG. 4 is a section view of the assembly of FIG. 2 taken along the line 4—4.

The structure and organization of block 12 is more clearly visible from the view of FIG. 3 which is the reverse of the view of FIG. 2. As there shown, connector block 12 is mounted on backplane 10, its terminal pins 13 extending via through holes outwardly therefrom. On the face of block 12 opposing the contact area face of board 20 is presented a coordinate array of contact springs 24 corresponding in rows and columns to the array of terminal contact areas 22 of board 20. Springs 24 are connected internally through block 12 to respective ones of terminal pins 13 and emerge from the face of block 12 in recesses 25 to permit spring flexure as will be more apparent from a consideration of FIG. 5 to follow. Also presented on the face of block 12 are two pairs of cam recesses 26 which are spaced to correspond to the spacings of cams 23 of board 20 and are dimensioned and contoured to admit the latter cams. The relative positions of connector block 12 and wiring board 20 shown in FIGS. 2 and 3 are also shown in the section view of FIG. 4 which also more clearly depicts the mechanisms for guiding board 20 into electrical association with block 12. As board 20 is inserted between the flanges of the guide rails—rail 16 for example—cams 23 bear along the inner surfaces of the rails to maintain board contact areas 22 out of engagement with connector block 12 contact springs 24. This separation is maintained as cams 23 continue their bearing on the opposing face of block 12. At this point a pair of spring clips 27 suitably mounted on the other flanges of guide rails 16 and 17 act on the opposite surface of board 20 finally to urge cams 23 of board 20 to seat in the recesses 26 presented in connector block 12.

Figure 5:
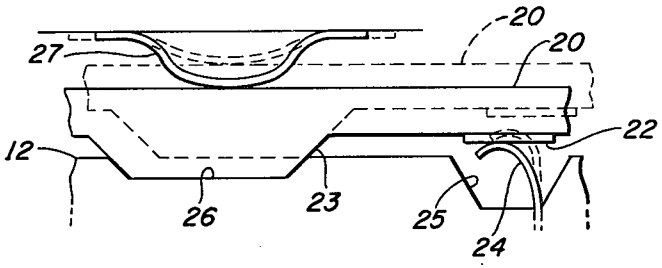
FIG. 5 depicts enlarged portions of a connector block-printed wiring board assembly according to the invention showing the operating mechanisms for achieving electrical contacts.

This may be more clearly seen in the enlarged view of FIG. 5 which shows a portion of the contacting mechanism. Board 20 is shown in dashed outline prior to the seating of its cams 23 into connector block recesses 26. As the latter seating occurs, the crown of spring clip 27 acting on the opposite surface of board 20 holds board 20 in place. At this time electrical contact between contact areas 22 and corresponding connector block 12 contact springs 24 is simultaneously and exclusively achieved as shown by the representative spring 24 and contact area 22. As mentioned in the foregoing, springs 24 emerge from connector block 12 in recesses 25; as is apparent from FIG. 5, a recess permits a full, unimpeded deflection as the printed wiring board 20 is urged toward block 12 by springs 27. Although a single connector-printed wiring board pair according to the invention is shown in FIG. 1 and described in the foregoing, it will be appreciated that in practice a number of such pairs will be interconnected with backplane 10.

What has been described is considered to be only one specific illustrative interconnection arrangement according to this invention. Accordingly, it will be understood that various and numerous other arrangements may be devised by one skilled in the art without departing from the spirit and scope of the invention as limited only by the scope of the accompanying claims.

What is claimed is:

1. Electrical interconnection apparatus comprising a printed wiring board (20) having a plurality of contact areas (22) thereon and a corresponding plurality of contact springs (24) for completing electrical circuits with said contact areas (22) characterized in that said plurality of contact areas (22) is arranged in a row substantially perpendicular to a leading edge of said board (20), and in a connector block (12) for mounting said springs (24) to extend from one face of said block in a row corresponding to said row of contact areas (22), guide means (16, 17) at two sides of said block (12) for admitting said board (20) and, thereby, said contact areas (22) into opposition with said springs (24) and means operating between said board (20) and said connector block (12) for ensuring simultaneous engagement of said contact areas (22) and corresponding springs (24) comprising cam means (23) for maintaining said contact areas (22) apart from said springs (24) and a corresponding recess (26) adapted and positioned to admit said cam means (23) only when said contact areas (22) and said springs (24) are in opposition.

2. Electrical interconnection apparatus comprising a printed wiring board (20) having a plurality of contact areas (22) thereon and a plurality of contact springs (24) corresponding, respectively, to said plurality of contact areas (22) for completing electrical circuts with said contact areas (22), characterized in that said plurality of contact areas is arranged in a row substantially perpendicular to a leading edge of said board (20), and in a connector block (12) for mounting said springs (24) to extend from one face of said block in a row corresponding to said row of contact areas (22), guide means (16, 17) at two sides of said block (12) for admitting said board (20) and, thereby, said contact areas (22) into opposition with said springs (24), and means for ensurng simultaneous engagement of said contact areas (22) and corresponding springs (24) comprising cam means (23) protuding from said board (20) toward said one face of said block (12) for maintaining said contact areas (22)

apart from said springs (24) and a corresponding recess (26) in said one face of said block (12) adapted and positioned to admit said cam means (23) only when said contact areas (22) and said springs (24) are in opposition.

3. Electrical interconnection apparatus as claimed in claim 2 further characterized in that said cam means (23) comprises a pair of cams at each side of said board (20) and in that a pair of corresponding recesses (26) are provided at each of said two sides of said block (12).

4. Electrical interconnection apparatus as claimed in claim 3 further characterized in a plurality of terminal pins (13) extending from another face of said block (12), said pins (13) being connected internally in said block (12) to respective ones of said springs (24).

5. Electrical interconnection apparatus comprising a printed wiring board having a plurality of contact areas arranged in a row substantially perpendicular to a leading edge thereof, a connector block mounting a plurality of contact springs to extend from one face thereof in a row corresponding to said row of contact areas, guide means for guiding said board and thereby said contact areas into opposition with said contact springs, and means for ensuring simultaneous engagement of said contact areas and corresponding contact springs comprising a cam protruding from said board toward said one face of said block for maintaining said contact areas apart from said springs and a corresponding recess in said one face of said block dimensioned and positioned to admit said cam only when said contact areas and said springs are in opposition.

6. Electrical interconnection apparatus as claimed in claim 5 also comprising a plurality of terminal pins internally connected in said block to respective ones of said contact springs extending from another face of said block.

7. Electrical interconnection apparatus as claimed in claims 5 or 6 also comprising spring means in said guide means for urging said board toward said one face of said connector block.

8. Electrical interconnection apparatus comprising a printed wiring board having rows and columns of contact areas affixed to a leading portion thereof, rows and columns of contact springs corresponding to said rows and columns of contact areas, guide means having ends extending past each end of said columns of springs for guiding said board and thereby said contact areas into opposition with said contact springs, and means for ensuring simultaneous engagement of said contact areas and corresponding contact springs comprising cam means protruding from said board toward said contact springs at each end of said columns of contact areas operating on a face of said guide means for maintaining said contact areas apart from said springs and corresponding recesses in said ends of said guide means dimensioned and positioned to admit said cam means only when said contact areas and said springs are in opposition.

* * * * *

UNITED STATES PATENT AND TRADEMARK OFFICE

CERTIFICATE OF CORRECTION

PATENT NO. : 4,279,459

DATED : July 21, 1981

INVENTOR(S) : Charles J. Sherman

It is certified that error appears in the above—identified patent and that said Letters Patent is hereby corrected as shown below:

In the claims, Column 4, claim 2, line 55, delete "circuts" and insert --circuits--.

In the claims, Column 4, claim 2, line 57, after "areas" insert --(22)--.

In the claims, Column 4, claim 2, line 67, delete "protuding" and insert --protruding--.

Signed and Sealed this

*Twenty-first* Day of *December 1982*

[SEAL]

*Attest:*

GERALD J. MOSSINGHOFF

*Attesting Officer*

*Commissioner of Patents and Trademarks*